US012377458B1

(12) United States Patent
Pagare et al.

(10) Patent No.: US 12,377,458 B1
(45) Date of Patent: Aug. 5, 2025

(54) HIGH PRESSURE DIE CASTING SYSTEM AND METHOD

(71) Applicant: GM Global Technology Operations LLC, Detroit, MI (US)

(72) Inventors: Sachin C. Pagare, New Nashik (IN); Marcel Taran, Novi, MI (US); William John Wilson, Clarkston, MI (US); Scott Marx, Burton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 18/733,668

(22) Filed: Jun. 4, 2024

(51) Int. Cl.
*B22D 17/22* (2006.01)
*B22D 33/04* (2006.01)

(52) U.S. Cl.
CPC ..... *B22D 17/22* (2013.01)

(58) Field of Classification Search
CPC ..... B22D 17/22; B22D 33/04
USPC ..... 164/339, 340, 341, 342, 113
See application file for complete search history.

(56) References Cited

U.S. PATENT DOCUMENTS

| | | | | |
|---|---|---|---|---|
| 4,347,889 | A * | 9/1982 | Komatsu et al. ..... | B22D 17/30 164/113 |
| 4,550,762 | A * | 11/1985 | West et al. ..... | B22D 19/0009 164/121 |
| 7,278,462 | B2 * | 10/2007 | Purdy et al. ..... | B22D 17/22 164/137 |
| 11,161,173 | B2 * | 11/2021 | Cheon ..... | B22D 17/2263 |
| 2007/0006988 | A1 * | 1/2007 | Heinrich et al. ... | B22D 19/0009 164/113 |

FOREIGN PATENT DOCUMENTS

DE 1268320 B 5/1968

* cited by examiner

*Primary Examiner* — Kevin P Kerns
(74) *Attorney, Agent, or Firm* — Honigman LLP; Matthew H. Szalach; Jonathan P. O'Brien

(57) ABSTRACT

A die casting system including a first die having a first cavity-forming surface, a second die having a second cavity-forming surface and is configured to move with respect to the first die along a first axis, and one or more sliding dies that each have a third cavity-forming surface configured to move with respect to and engage with the first die and the second die. The die casting system further including one or more auxiliary die elements removably coupled to the second die and each having a fourth cavity-forming surface. The one or more auxiliary die elements each extending from the second die in a direction perpendicular to the first axis. The die casting system further including a die cavity for forming a metal part between the first, second, third, and fourth cavity-forming surfaces.

18 Claims, 9 Drawing Sheets

HIGH PRESSURE DIE CASTING SYSTEM AND METHOD

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates generally to die casting and, more particularly, to a system and method of high pressure die casting.

High pressure die casting (HPDC) is a manufacturing process that involves injecting a molten material (e.g., aluminum, zinc, magnesium, etc.) into a mold cavity or die under high pressure to form metal parts. Automotive applications account for a large share of a HPDC market. For instance, HPDC is commonly used for production of vehicle closure parts, body-in-white parts, as well as chassis and powertrain applications.

During manufacturing, HPDC relies on one or more dies that engage with one another to form a die cavity that can receive a molten material. Once the molten material cools and forms a metal part, at least one of the one or more dies needs to be configured to retract from the metal part so that the metal part can be removed. Die lock situations arise when the metal part is formed within the cavity but one or more of the dies cannot retract from the metal part. Existing systems and methods are limited in this regard and must be designed accordingly to avoid a die lock situation. One or more aspects of the present disclosure address shortcomings of the existing systems and methods.

SUMMARY

A die casting system is provided and includes a first die having a first cavity-forming surface, a second die having a second cavity-forming surface and configured to move with respect to the first die along a first axis, and one or more sliding dies that each have a third cavity-forming surface and are configured to move with respect to and engage with the first die and the second die. The die casting system further including one or more auxiliary die elements removably coupled to the second die and each having a fourth cavity-forming surface. The one or more auxiliary die elements each extending from the second die in a direction perpendicular to the first axis. The die casting system further including a die cavity for forming a metal part between the first, second, third, and fourth cavity-forming surfaces.

The die casting system may include one or more of the following aspects. For example, the first die can be stationary with respect to the first axis.

According to at least one aspect, the second die can include one or more grooves that extend with respect to the first axis and the one or more auxiliary die elements can each include a tongue configured for the one or more grooves.

According to another aspect, the one or more auxiliary die elements can be made of aluminum or steel. At least one of the one or more auxiliary die elements can include a brick shape. At least one of the one or more auxiliary die elements can include a block shape. At least one of the one or more auxiliary die elements can include a disc shape. At least one of the one or more auxiliary die elements can include a cylindrical shape.

According to at least one example, the die casting system can be configured to move between an open position and a closed position. The one or more auxiliary die elements can be configured to decouple from the second die when the die casting system moves from the closed position to the open position after a metal part is formed in the die cavity.

In another configuration, a method of high pressure die casting is provided and includes coupling an auxiliary die element to a movable die, actuating the movable die along a first axis to engage with a stationary die, actuating one or more sliding dies to engage with the movable die and the stationary die to form a die cavity, injecting a metal material into the die cavity to form a metal part, retracting the one or more sliding dies from the movable die and the stationary die, retracting the movable die so that the auxiliary die element is decoupled from the movable die, and removing the auxiliary die element from the metal part.

The die method may include one or more of the following aspects or steps. For example, coupling the auxiliary die element to t movable die can further include inserting a tongue of the auxiliary die element into a groove of the movable die with respect to the first axis.

According to at least one aspect, coupling the auxiliary die element to the movable die may further include coupling a first auxiliary die element, a second auxiliary die element, and a third auxiliary die element to the movable die.

According to another aspect, the auxiliary die element can be made of aluminum or steel. The auxiliary die element can be configured to form a feature in the metal part that extends in a direction perpendicular to the first axis. The auxiliary die element can include a brick shape. The auxiliary die element can include a block shape. The auxiliary die element can include a disc shape. The auxiliary die element can include a cylindrical shape.

According to at least one example, the method further includes spraying the auxiliary die element, the stationary die, the movable die, and the one or more sliding dies with a release agent.

BRIEF DESCRIPTION OF THE DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
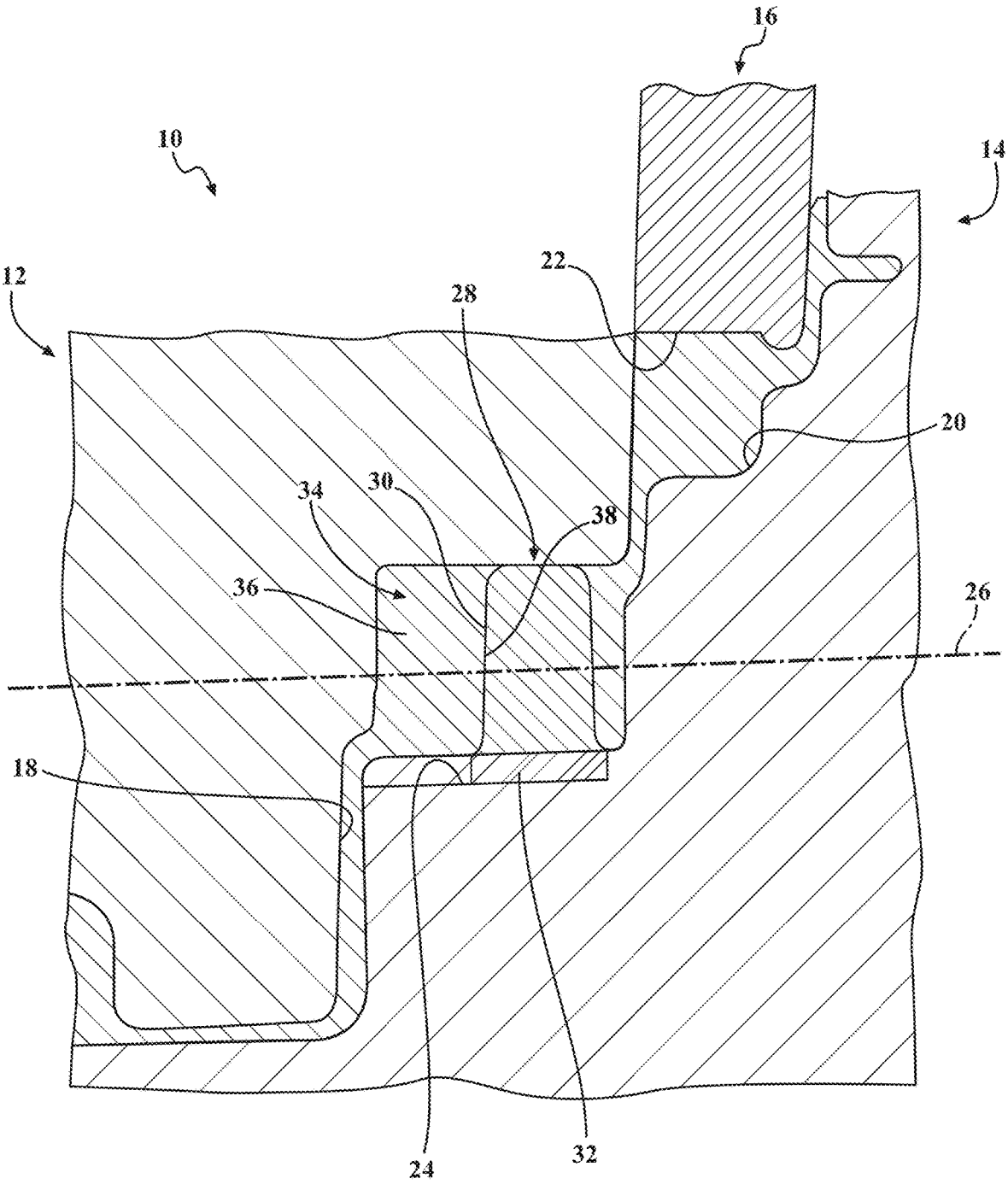
FIG. 1 is a schematic view of a die casting system according to principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms "first," "second," "third," etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In this application, including the definitions below, the term "module" may be replaced with the term "circuit." The term "module" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term "code," as used above, may include software, firmware, and/or microcode, and may refer to programs, routines, functions, classes, and/or objects. The term "shared processor" encompasses a single processor that executes some or all code from multiple modules. The term "group processor" encompasses a processor that, in combination with additional processors, executes some or all code from one or more modules. The term "shared memory" encompasses a single memory that stores some or all code from multiple modules. The term "group memory" encompasses a memory that, in combination with additional memories, stores some or all code from one or more modules. The term "memory" may be a subset of the term "computer-readable medium." The term "computer-readable medium" does not encompass transitory electrical and electromagnetic signals propagating through a medium, and may therefore be considered tangible and non-transitory memory. Non-limiting examples of a non-transitory memory include a tangible computer readable medium including a nonvolatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

A software application (i.e., a software resource) may refer to computer software that causes a computing device to perform a task. In some examples, a software application may be referred to as an "application," an "app," or a "program." Example applications include, but are not limited to, system diagnostic applications, system management applications, system maintenance applications, word processing applications, spreadsheet applications, messaging applications, media streaming applications, social networking applications, and gaming applications.

The non-transitory memory may be physical devices used to store programs (e.g., sequences of instructions) or data (e.g., program state information) on a temporary or permanent basis for use by a computing device. The non-transitory memory may be volatile and/or non-volatile addressable semiconductor memory. Examples of non-volatile memory include, but are not limited to, flash memory and read-only memory (ROM)/programmable read-only memory (PROM)/erasable programmable read-only memory (EPROM)/electronically erasable programmable read-only memory (EEPROM) (e.g., typically used for firmware, such as boot programs). Examples of volatile memory include, but are not limited to, random access memory (RAM), dynamic random access memory (DRAM), static random access memory (SRAM), phase change memory (PCM) as well as disks or tapes.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Various implementations of the systems and techniques described herein can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

The processes and logic flows described in this specification can be performed by one or more programmable processors, also referred to as data processing hardware, executing one or more computer programs to perform functions by operating on input data and generating output. The processes and logic flows can also be performed by special purpose logic circuitry, e.g., an FPGA (field programmable gate array) or an ASIC (application specific integrated circuit). Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

With reference to FIG. 1, a die casting system 10 for forming metal parts is provided. The die casting system 10 can include a first or stationary die 12, a second or movable die 14, and one or more sliding dies 16. The stationary die 12 includes a first cavity-forming surface 18 and the movable die 14 includes a second cavity-forming surface 20. The one or more sliding dies 16 can be arranged with respect to and engage with the stationary and movable dies 12, 14. Additionally, the one or more sliding dies 16 can have a third cavity-forming surface 22.

The movable die 14 can include a groove or first attachment feature 24 extending along a portion of the second cavity-forming surface 20. In the present illustrative configuration, the movable die 14 is configured to move with respect to the stationary die 12 along a first axis 26.

The die system 10 can further include one or more auxiliary die elements 28 that each include a fourth cavity-forming surface 30. The one or more auxiliary die elements 28 can be formed of aluminum or steel. According to one aspect of the present disclosure, the one or more auxiliary die elements 28 can be removably coupled to or otherwise arranged on the movable die 14 so as to extend from the second cavity-forming surface 20 in a direction perpendicular to the first axis 26. In other words, the one or more auxiliary die elements 28 can each include a tongue or second attachment feature 32 that can be arranged in the groove 24 of the movable die 14. As will be discussed in more detail below, the one or more auxiliary die elements 28 can vary in shape and size. For instance, the one or more auxiliary die elements 28 can comprise a brick, a block, a disc, a cylinder (i.e., a cylindrical shape), or another shape for forming a complex geometrical feature in a metal part.

The die system 10 includes an open position (FIGS. 3C, 4C, 6C, 8C) and a closed position (FIGS. 1, 3B, 4B, 6B, and 8B). In the open position, the one or more auxiliary die elements 28 can be coupled to or arranged on the movable die 14. In the closed position, the die casting system 10 includes a die cavity 34 that is defined at least by the first, second, third, and fourth cavity-forming surfaces 18, 20, 22, 30. The die cavity 34 can be configured to receive a molten metal material such as aluminum, zinc, magnesium, or steel to form a metal part 36 including at least one complex geometrical feature 38.

FIGS. 2 and 3A-3C illustrate another illustrative configuration of a die casting system 110. This configuration is similar in many respects to the configuration of FIG. 1. Accordingly, the descriptions of the configurations are hereby incorporated into one another, and description of subject matter common to the configurations generally may not be repeated.

Figure 2:
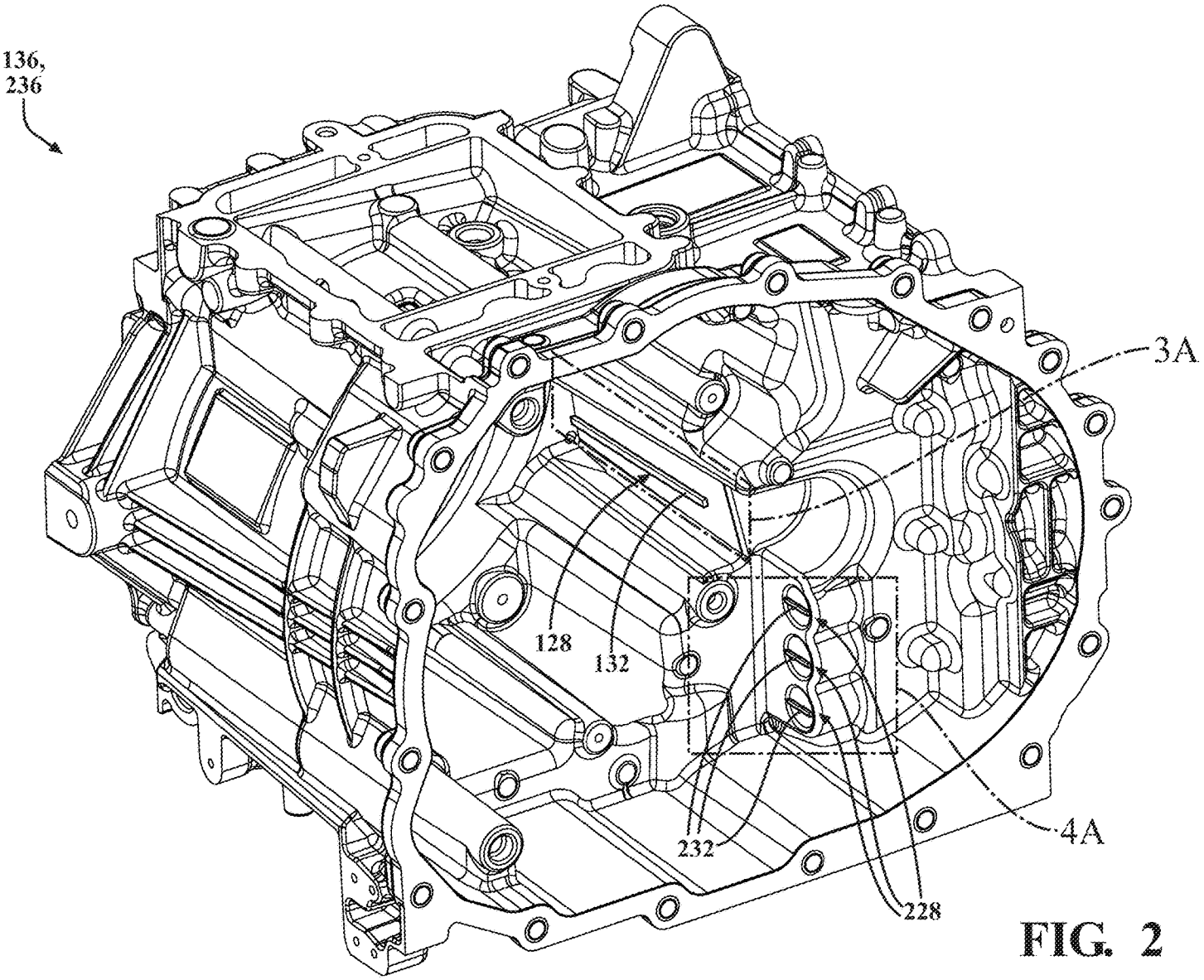
FIG. 2 is a perspective view of a motor housing.
Figure 3A:
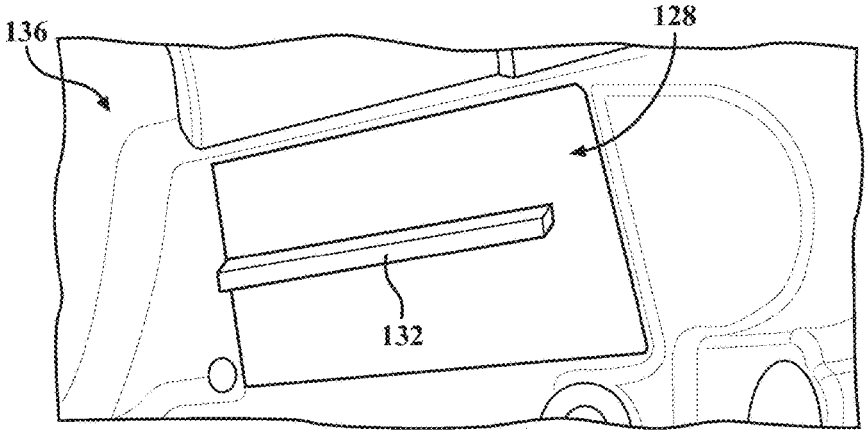
FIG. 3A close up perspective view of the motor housing of FIG. 2 having a first configuration of an auxiliary die arranged in a portion of the motor housing.
Figure 3B:
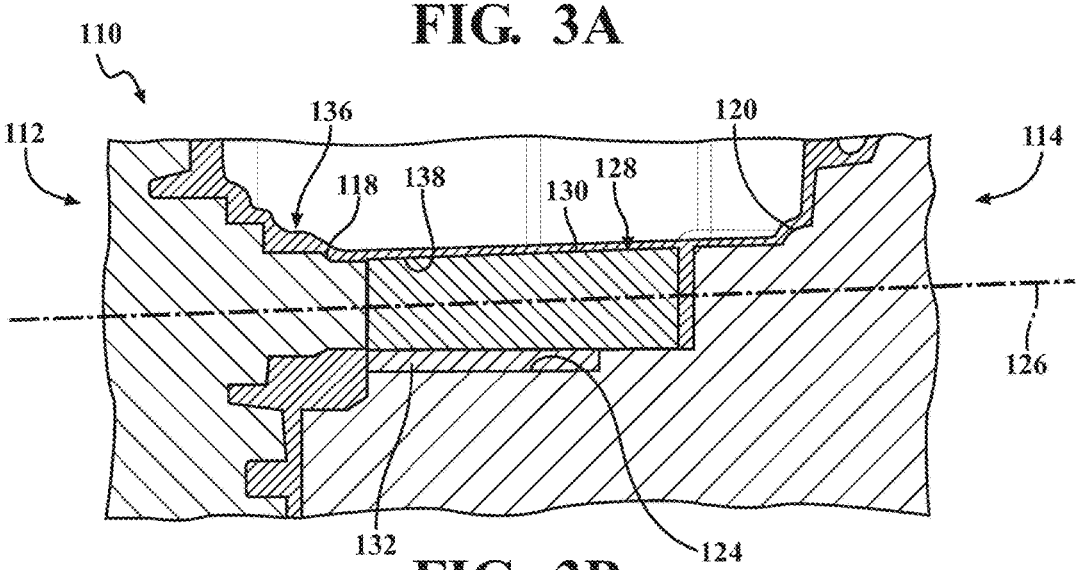
FIG. 3B is a cross-sectional view of a first configuration of a die casting system in accordance with the principles of the present disclosure shown in a closed position.
Figure 3C:
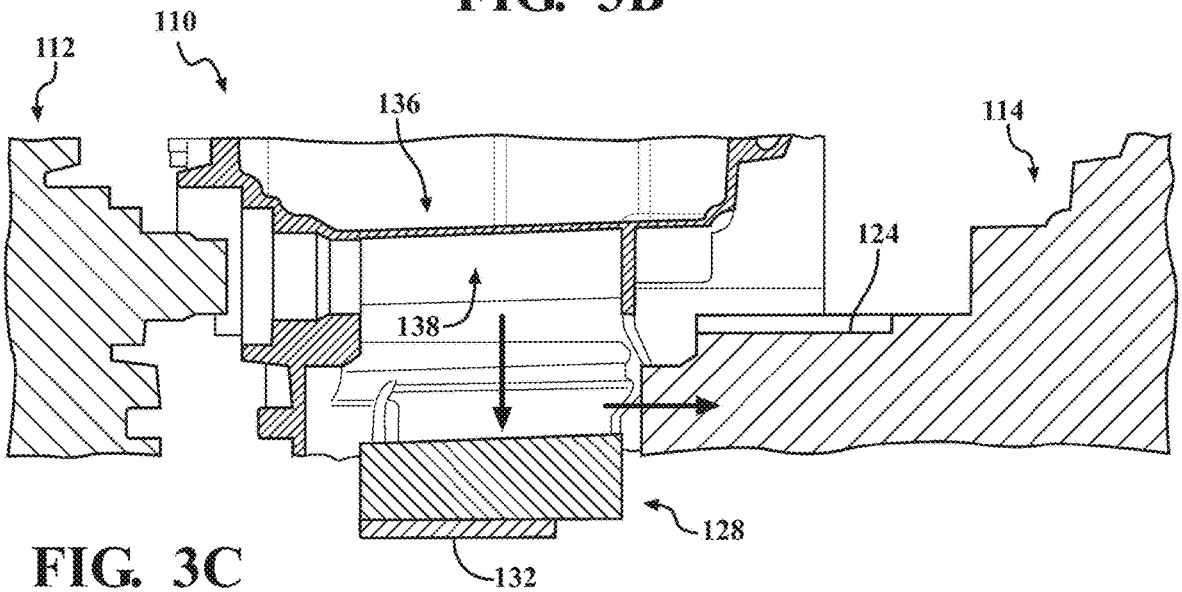
FIG. 3C is a cross-sectional view of the first configuration of the die casting system of FIG. 3B shown in an open position.

With reference to FIGS. 2 and 3A-3C, the die casting system 110 (FIGS. 3A-3C) can be configured to form a metal part or motor housing 136 (FIG. 2) including a first complex geometrical feature or baffle 138 (FIGS. 3B and 3C). The baffle 138 cannot be formed with traditional high pressure die casting systems and methods because it would result in a die lock situation (i.e., one or more dies could not pull away from the metal part after forming). Forming the baffle 138 in the motor housing 136 may be desirable to help eliminate oil churning that results in transmission or drive unit energy losses.

With reference to FIG. 3B, the die casting system 110 includes a first or stationary die 112 and a second or movable die 114. The stationary die 112 includes a first cavity-forming surface 118. The movable die 114 includes a groove 124 extending along a portion of a second cavity-forming surface 120 with respect to a first axis 126. An auxiliary die element 128 shaped like a brick can be coupled to or arranged on the movable die 114. More particularly, the auxiliary die element 128 can include a tongue 132 that is configured to engage with the groove 124 of the movable die 114. The auxiliary die element 128 includes a fourth cavity-forming surface 130. According to one aspect, the auxiliary die element 128 extends from the movable die 114 in a direction perpendicular to the first axis 126. In other words, the auxiliary die element 128 can be configured to form the first complex geometrical feature 138 in a direction that is perpendicular to the first axis 126.

With reference to FIG. 3C, after the motor housing 136 is formed, the movable die 114 is retracted (i.e., actuated) away from the motor housing 136 along the first axis 126. In this configuration, a portion of the motor housing 136 prevents the auxiliary die element 128 from moving axially with the movable die 114. Thus, the auxiliary die element 128 can decouple from the movable die 114 when the movable die 114 is retracted along the first axis 126 (FIGS. 2 and 3A). The auxiliary die element 128 can subsequently fall from the motor housing 136 or the auxiliary die element 128 can be removed from the motor housing 136 by an operator or a machine. Note, after the auxiliary die element 128 is removed from the motor housing 136, the auxiliary die element 128 can be reused in subsequent forming processes of additional motor housings.

FIGS. 2 and 4A-4C illustrate another illustrative configuration of a die casting system 210. This configuration is similar in many respects to the configurations of FIGS. 1 and 3A-3C. Accordingly, the descriptions of the configurations are hereby incorporated into one another, and description of subject matter common to the configurations generally may not be repeated.

With reference to FIGS. 2 and 4A-4C, the die casting system 210 (FIGS. 4A-4C) can be configured to form a metal part or motor housing 236 (FIG. 2) including one or more second complex geometrical features 238 (FIGS. 3B and 3C). The one or more second complex geometrical features 238 cannot be formed with traditional high pressure die casting systems and methods because it would result in a die lock situation (i.e., one or more dies could not pull away from the metal part after forming). Forming the one or more second complex geometrical features 238 in the motor housing 236 may be desirable to help improve efficiency and/or eliminate energy losses during operation, for example.

Figure 4A:
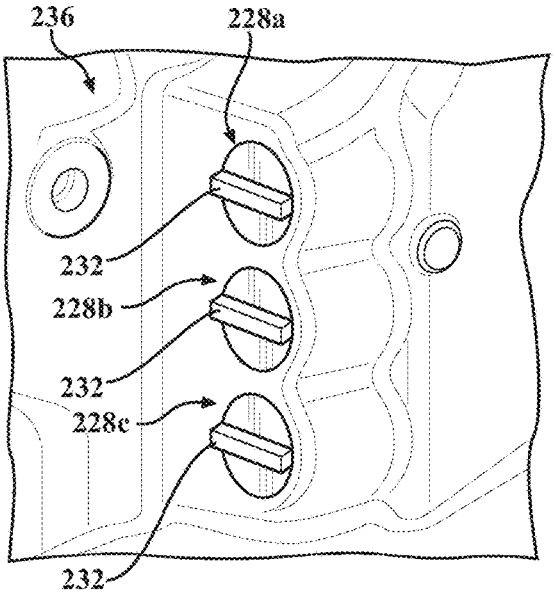
FIG. 4A is a close up perspective view of the motor housing of FIG. 2 having a second configuration of one or more auxiliary dies arranged in a portion of the motor housing.
Figure 4B:
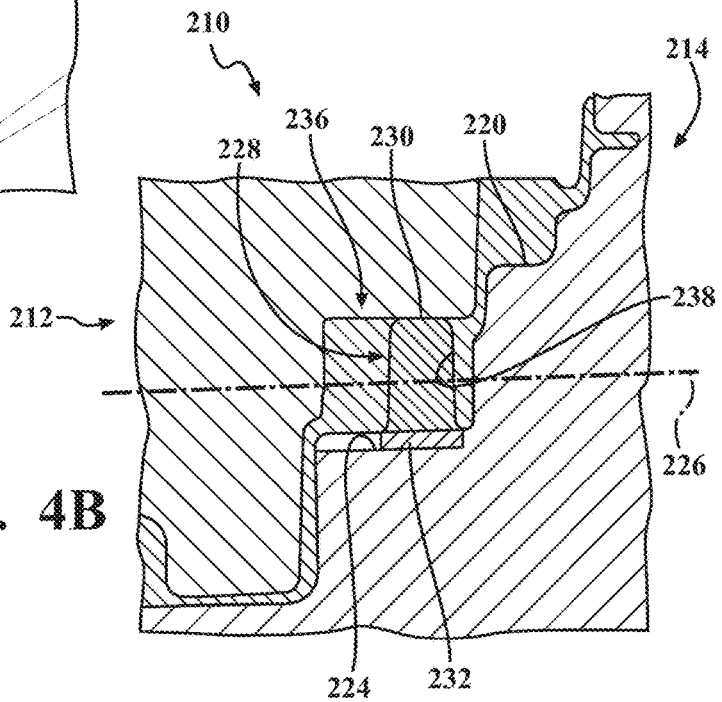
FIG. 4B is a cross-sectional view of a second configuration of a die casting system in accordance with the principles of the present disclosure shown in a closed position.

With reference to FIG. 4B, the die casting system 210 includes a first or stationary die 212 and a second or movable die 214. The movable die 214 includes one or more grooves 224 extending along a portion of a second cavity-forming surface 220 with respect to a first axis 226. One or more auxiliary die elements 228 having a cylindrical shape can be coupled to or arranged on the movable die 214. More particularly, with reference to FIG. 4A, the one or more auxiliary die elements 228 include a first auxiliary die element 228*a*, a second auxiliary die element 228*b*, and a third auxiliary die element 228*c*, each including a tongue 232 that is configured to engage with the one or more grooves 224 of the movable die 214. The auxiliary die element 228 includes a fourth cavity-forming surface 230. According to one aspect, each of the auxiliary die elements 228 extends from the movable die 214 in a direction perpendicular to the first axis 226. In other words, the auxiliary die elements 228 can be configured to form one or more of the second complex geometrical features 238 in a direction that is perpendicular to the first axis 226.

Figure 4C:
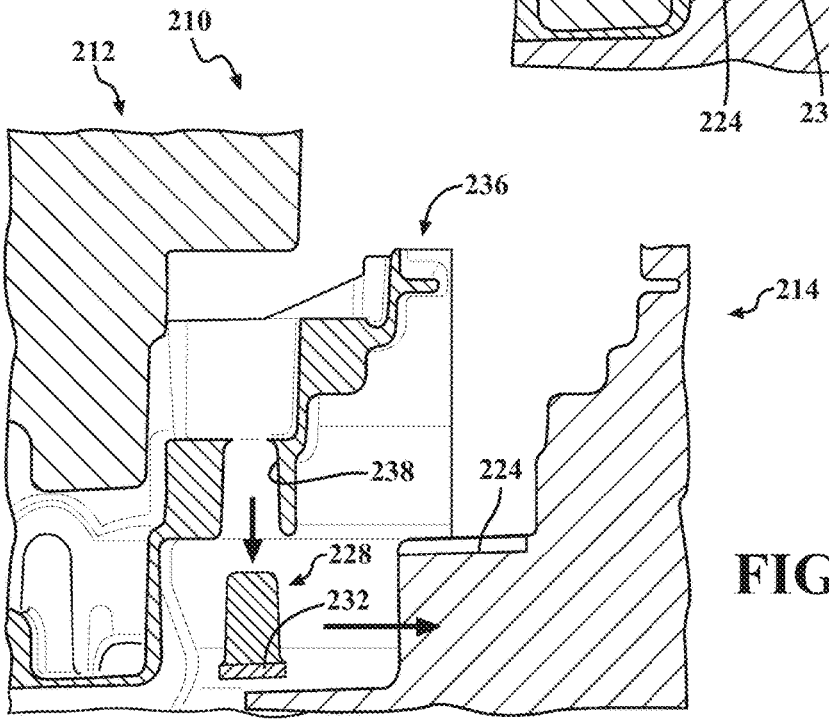
FIG. 4C is a cross-sectional view of the die casting system of FIG. 4B shown in an open position.

With reference to FIG. 4C, after the motor housing 236 is formed the movable die 214 is retracted (i.e., actuated) away from the motor housing 236 along the first axis 226. In this configuration, a portion of the motor housing 236 prevents the one or more auxiliary die elements 228 from moving axially with the movable die 214. Thus, the one or more auxiliary die elements 228 can decouple from the movable die 214 when the movable die 214 is retracted along the first axis 226 (FIGS. 2 and 4A). The one or more auxiliary die elements 228 can subsequently fall from the motor housing 236 or the one or more auxiliary die elements 228 can be removed from the motor housing 236 by an operator or a machine. Note, after the auxiliary die element 228 is removed from the motor housing 236, the auxiliary die element 228 can be reused in subsequent forming processes of additional motor housings.

FIGS. 5 and 6A-6C illustrate another illustrative configuration of a die casting system 310. This configuration is similar in many respects to the configuration of FIGS. 1, 2, 3A-3C, and 4A-4C. Accordingly, the descriptions of the configurations are hereby incorporated into one another, and description of subject matter common to the configurations generally may not be repeated.

Figure 5:
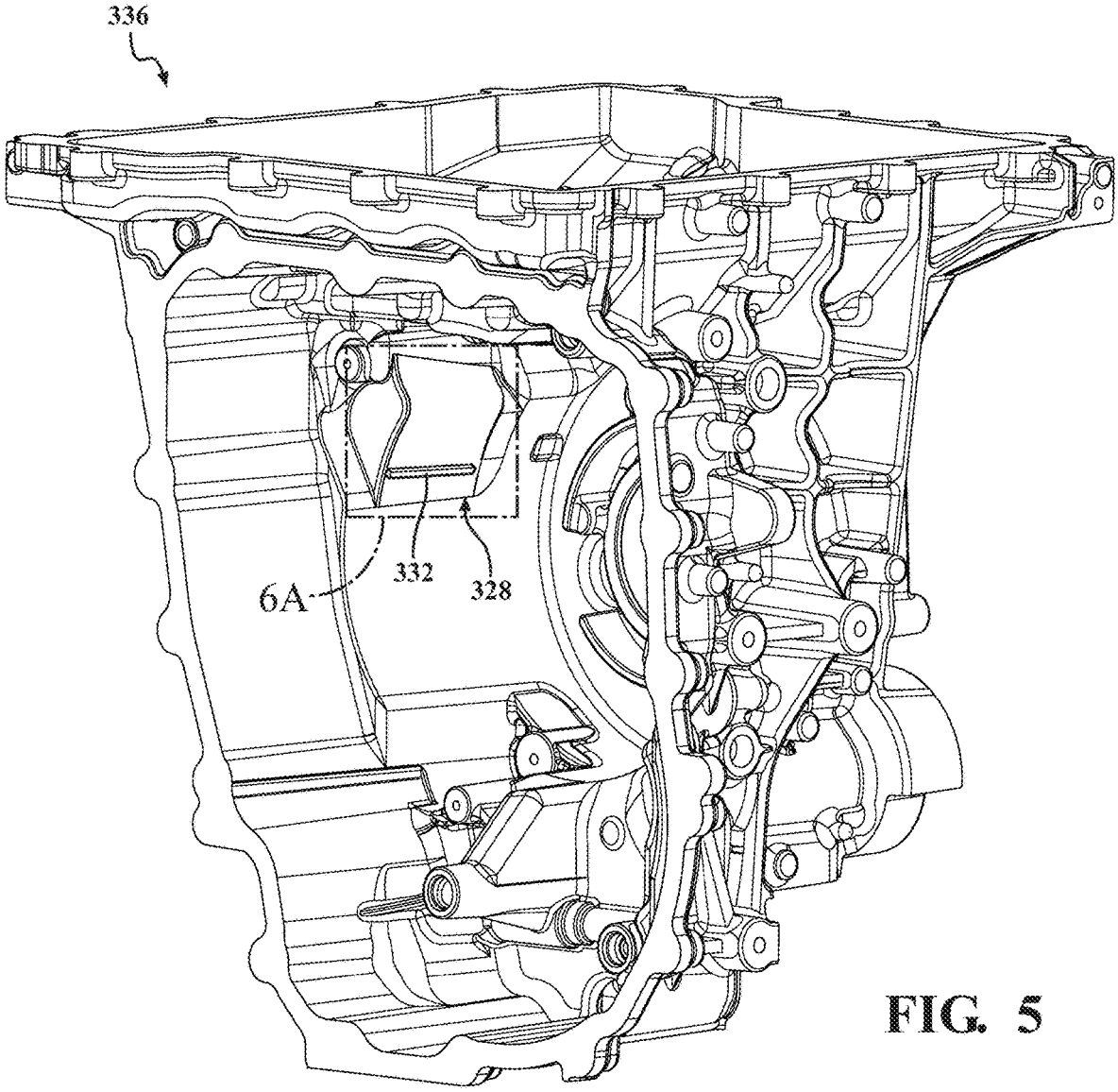
FIG. 5 is a perspective view of a drive unit motor housing.
Figure 6A:
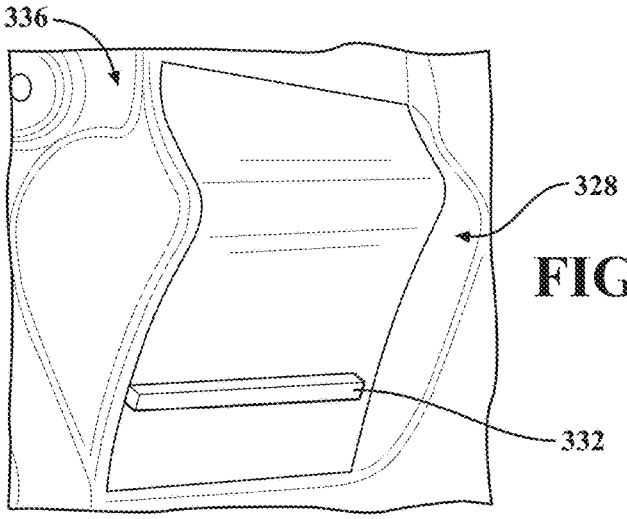
FIG. 6A is a close up perspective view of the drive unit motor housing of FIG. 5 having a third configuration of an auxiliary die arranged in a portion of the drive unit motor housing.
Figure 6B:
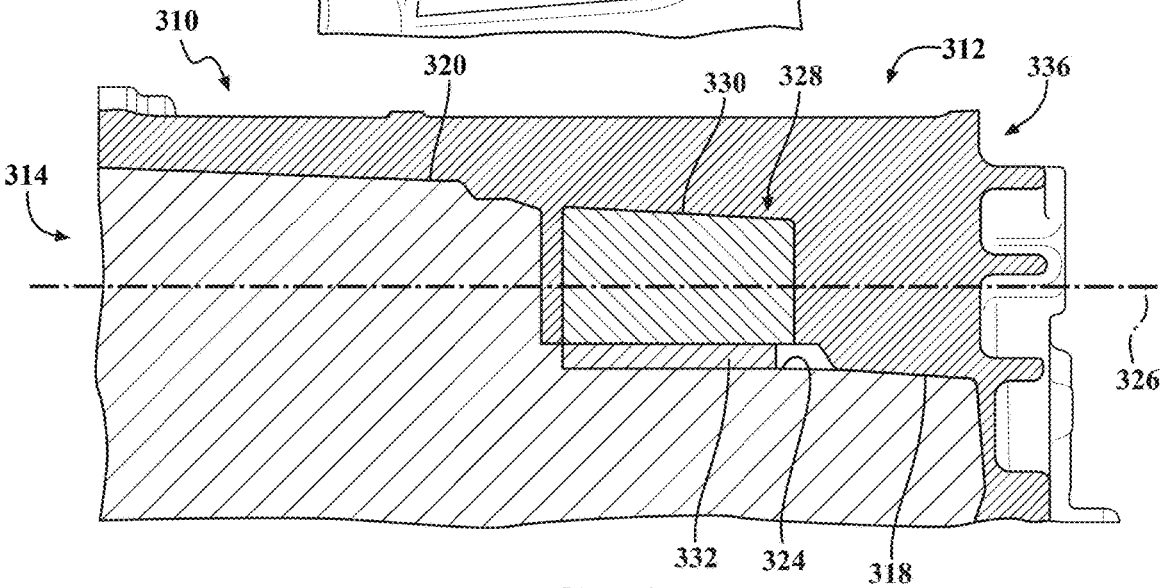
FIG. 6B is a cross-sectional view of a third configuration of a die casting system in accordance with the principles of the present disclosure shown in a closed position.
Figure 6C:
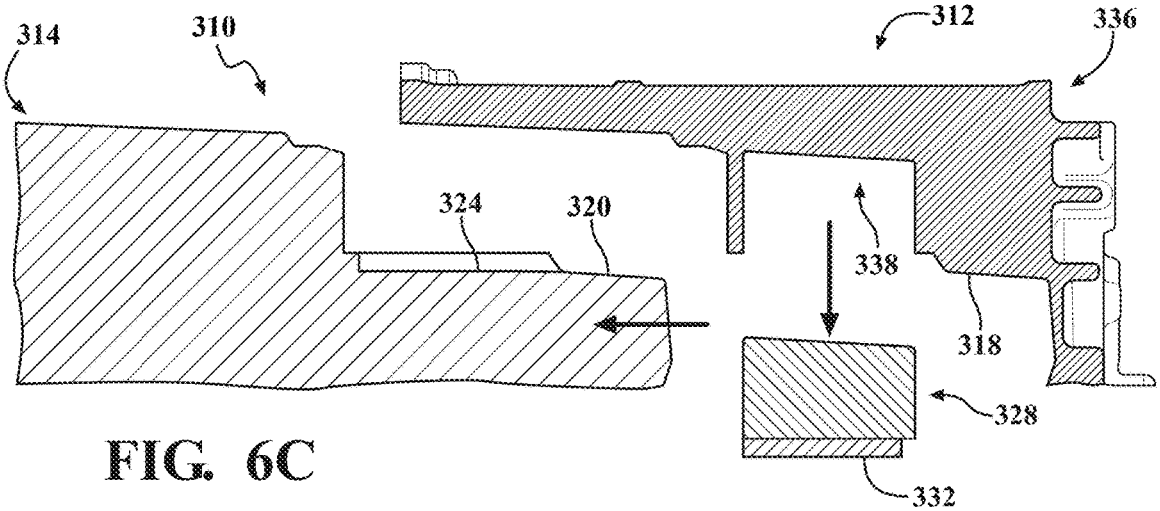
FIG. 6C is a cross-sectional view of the die casting system of FIG. 6B shown in an open position.

With reference to FIGS. 5 and 6A-6C, the die casting system 310 (FIGS. 6A-6C) can be configured to form a metal part or transfer case 336 (FIG. 5) including a third complex geometrical feature 338 (FIGS. 6B and 6C). The third complex geometrical feature 338 cannot be formed with traditional high pressure die casting systems and methods because it would result in a die lock situation (i.e., one or more dies could not pull away from the metal part after forming). Forming the third complex geometrical feature 338 in the transfer case 336 may be desirable to reduce cost and/or reduce the number of parts per assembly.

With reference to FIG. 6B, the die casting system 310 includes a first or stationary die 312 and a second or movable die 314. The stationary die element 312 includes a first cavity-forming surface 318. The movable die 314 includes a groove 324 extending along a portion of a second cavity-forming surface 320 with respect to a first axis 326. An auxiliary die element 328 shaped like a block can be coupled to or arranged on the movable die 314. More particularly, the auxiliary die element 328 can include a tongue 332 that is configured to engage with the groove 324 of the movable die 314. The auxiliary die element 328 includes a fourth cavity-forming surface 330. According to one aspect, the auxiliary die element 328 extends from the movable die 314 in a direction perpendicular to the first axis 326. In other words, the auxiliary die element 328 can be configured to form the third complex geometrical feature 338 in a direction that is perpendicular to the first axis 326.

With reference to FIG. 6C, after the transfer case 336 is formed the movable die 314 is retracted (i.e., actuated) away from the transfer case 336 along the first axis 326. In this configuration, a portion of the transfer case 336 prevents the auxiliary die element 328 from moving axially with the movable die 314. Thus, the auxiliary die element 328 can decouple from the movable die 314 when the movable die 314 is retracted along the first axis 326 (FIGS. 5 and 6A). The auxiliary die element 328 can subsequently fall from the transfer case 336 or the auxiliary die element 328 can be removed from the transfer case 336 by an operator or a machine. Note, after the auxiliary die element 328 is removed from the transfer case 336, the auxiliary die element 328 can be reused in subsequent forming processes of additional transfer cases.

FIGS. 7 and 8A-8C illustrate another illustrative configuration of a die casting system 410. This configuration is similar in many respects to the configuration of FIGS. 1, 2, 3A-3C, 4A-4C, 5, and 6A-6C. Accordingly, the descriptions of the configurations are hereby incorporated into one another, and description of subject matter common to the configurations generally may not be repeated.

Figure 7:
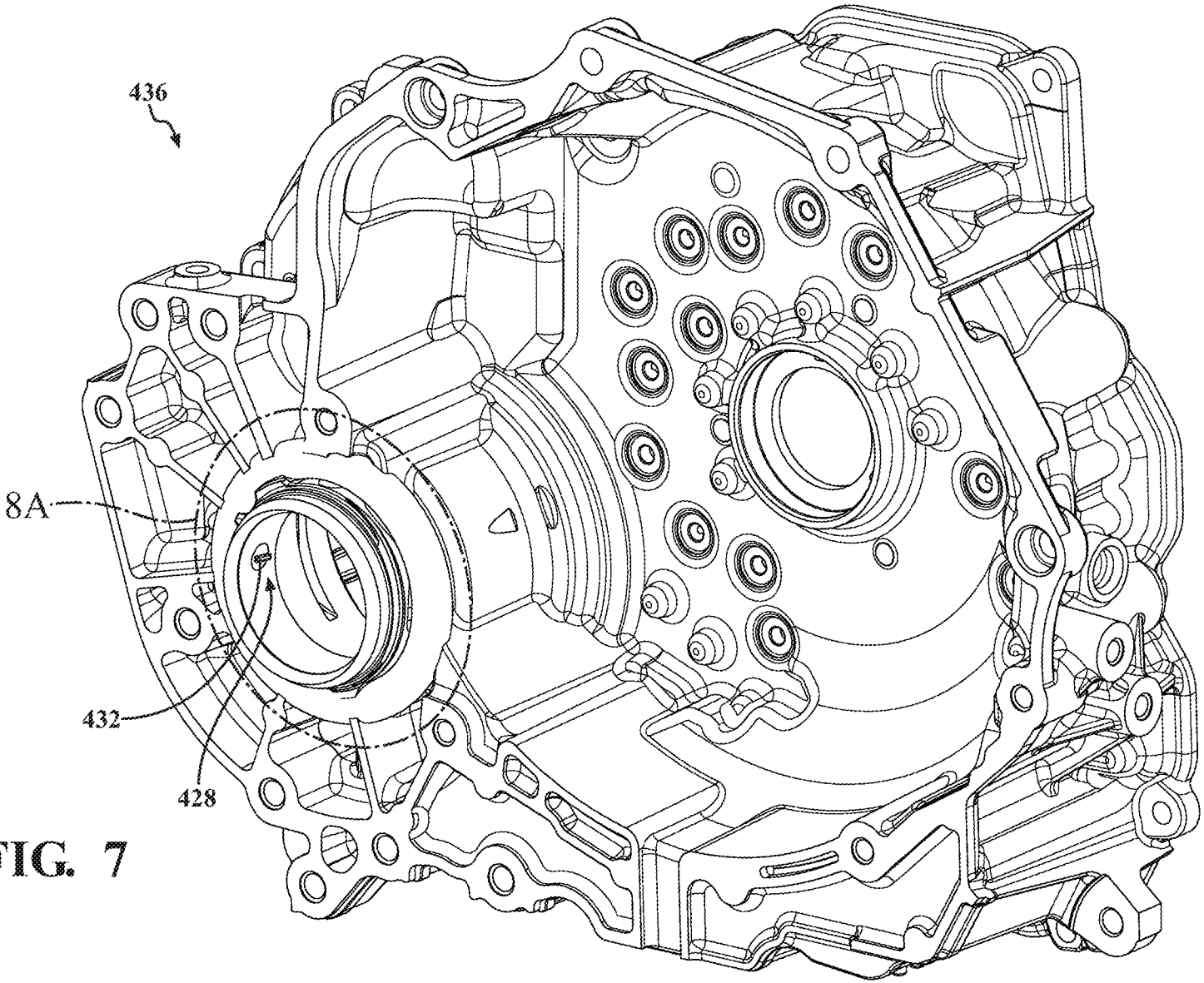
FIG. 7 is a perspective view of a transmission housing.
Figure 8A:
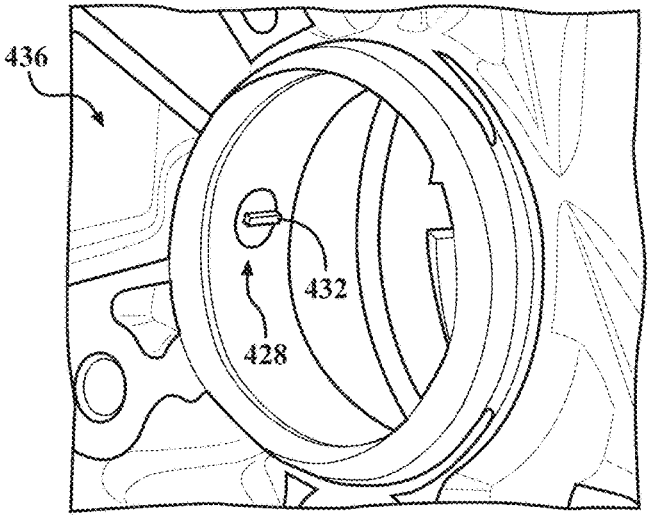
FIG. 8A is a close up perspective view of the transmission housing of FIG. 7 having a fourth configuration of an auxiliary die arranged in a portion of the transmission housing.
Figure 8B:
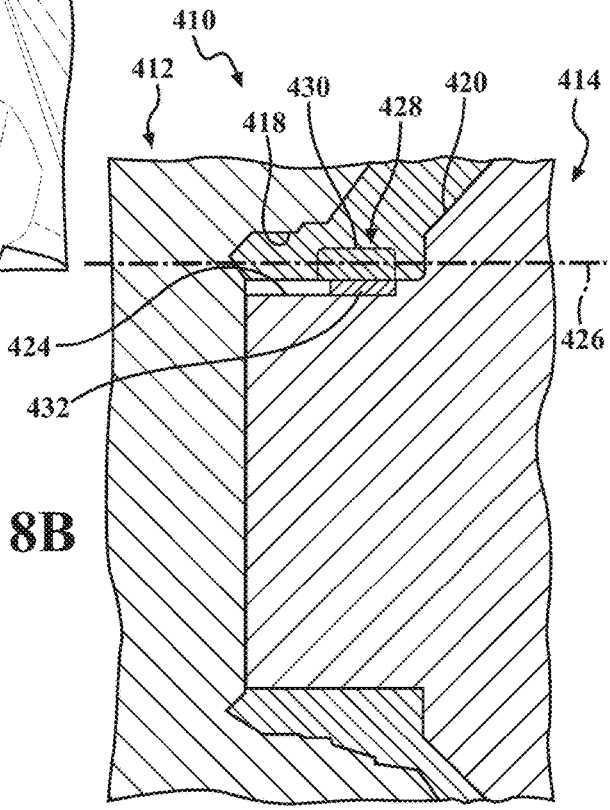
FIG. 8B is a cross-sectional view of a fourth configuration of a die casting system in accordance with the principles of the present disclosure shown in a closed position.
Figure 8C:
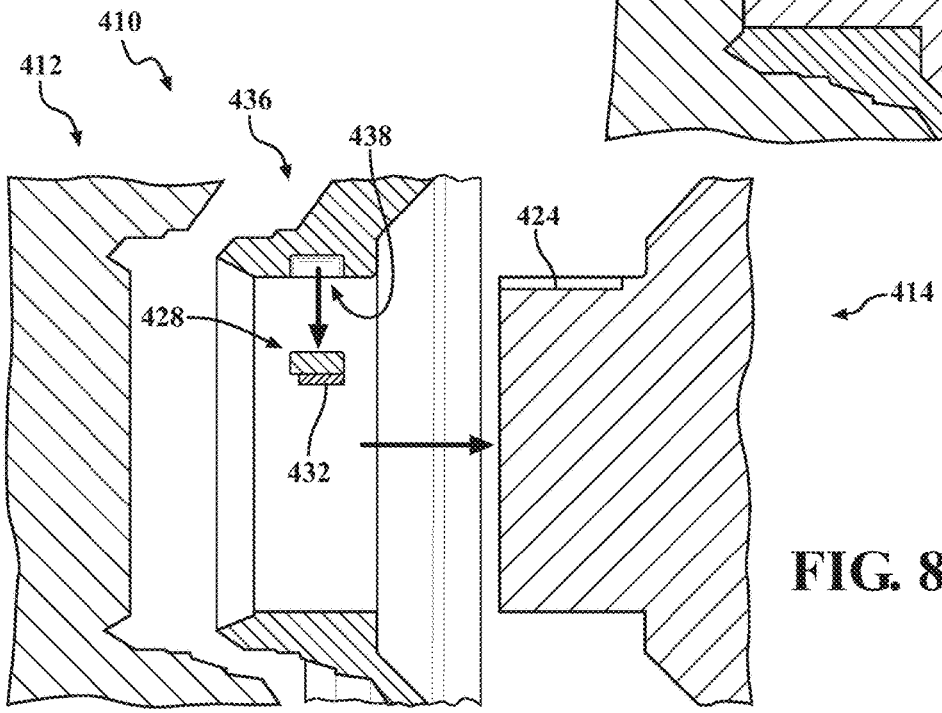
FIG. 8C is a cross-sectional view of the fourth configuration of the die casting system of FIG. 8B shown in an open position.

With reference to FIGS. 7 and 8A-8C, the die casting system 410 (FIGS. 8A-8C) can be configured to form a metal part or transmission housing 436 (FIG. 7) including a fourth complex geometrical feature 438 (FIGS. 8B and 8C). The fourth complex geometrical feature 438 cannot be formed with traditional high pressure die casting systems and methods because it would result in a die lock situation (i.e., one or more dies could not pull away from the metal part after forming). Forming the fourth complex geometrical feature 438 in the transmission housing 436 may be desirable to help a user (e.g., a machinist) easily locate where to drill an oil passage in the transmission housing 436, for example.

With reference to FIG. 8B, the die casting system 410 includes a first or stationary die 412 and a second or movable die 414. The stationary die element 412 includes a first cavity-forming surface 418. The movable die 414 includes a groove 424 extending along a portion of a second cavity-forming surface 420 with respect to a first axis 426. An auxiliary die element 428 shaped like a disc can be coupled to or arranged on the movable die 414. More particularly, the auxiliary die element 428 can include a tongue 432 that is configured to engage with the groove 424 of the movable die 414. The auxiliary die element 428 includes a fourth cavity-forming surface 430. According to one aspect, the auxiliary die element 428 extends from the movable die 414 in a direction perpendicular to the first axis 426. In other words, the auxiliary die element 428 can be configured to form the third complex geometrical feature 438 in a direction that is perpendicular to the first axis 426.

With reference to FIG. 8C, after the transmission housing 436 is formed the movable die 414 is retracted (i.e., actuated) away from the transmission housing 436 along the first axis 426. In this configuration, a portion of the transmission housing 436 prevents the auxiliary die element 428 from moving axially with the movable die 414. Thus, the auxiliary die element 428 can decouple from the movable die 414 when the movable die 414 is retracted along the first axis 426 (FIGS. 7 and 8A). The auxiliary die element 428 can subsequently fall from the transmission housing 436 or the auxiliary die element 428 can be removed from the transmission housing 436 by an operator or a machine. Note, after the auxiliary die element 428 is removed from the transmission housing 436, the auxiliary die element 428 can be reused in subsequent forming processes of additional transmission housings.

Figure 9:
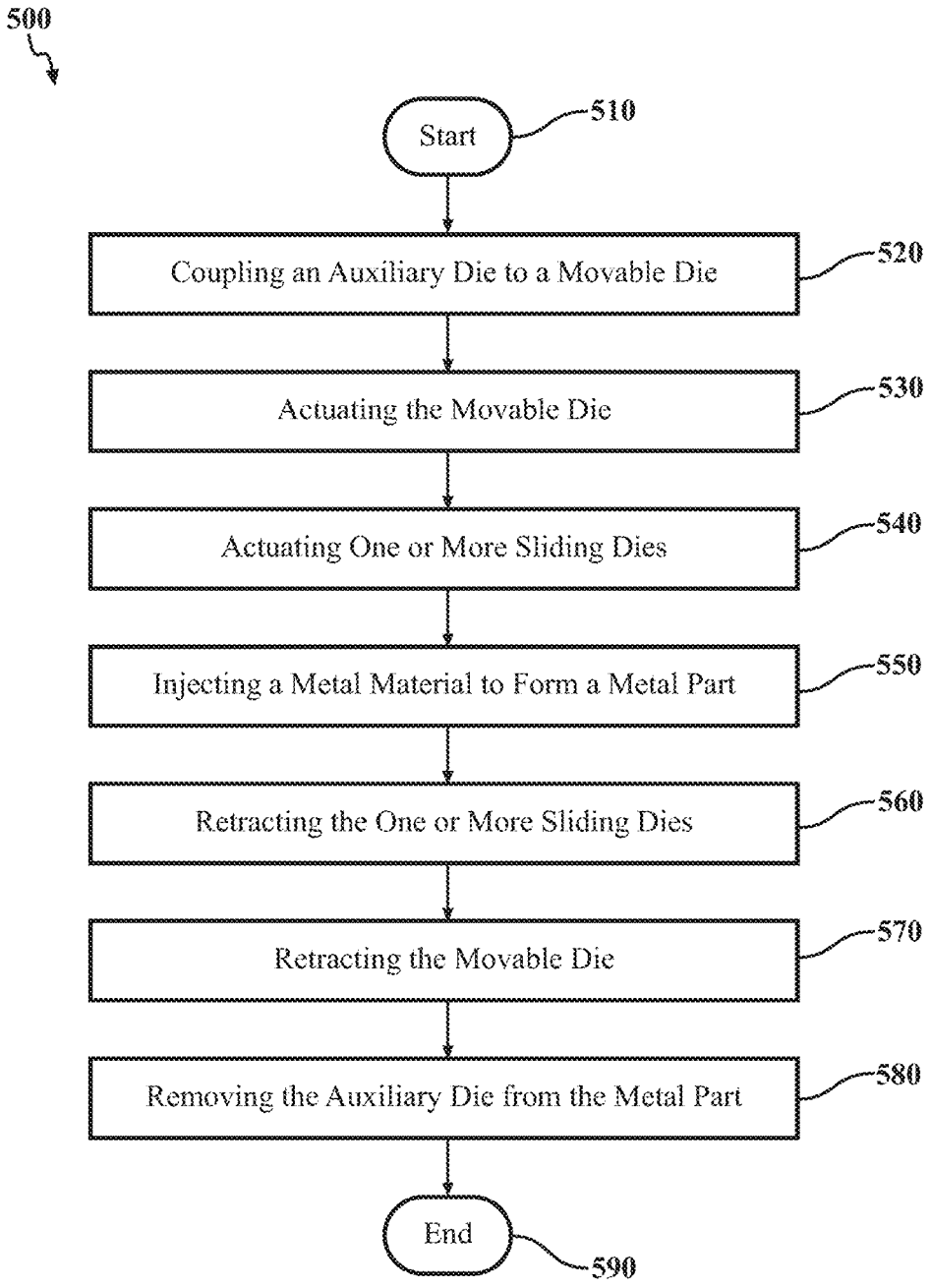
FIG. 9 is a flow diagram showing operations of the die casting system of FIG. 1.

With reference to FIG. 9, a method 500 of forming metal parts with one or more complex geometrical features is provided. The method 500 is initiated at 510 when the die casting system 10, 110, 210, 310, 410 is powered on, for example. The method 500 will be discussed with respect to the die casting system 10 but equally applies to the die casting systems 110, 210, 310, 410 as well.

At 520, the auxiliary die element 28 (e.g., brick, block, disc, cylinder, etc.) is coupled to the movable die 14 while the die casting system 10 is in the open position. In other words, the auxiliary die element 28 can be removably coupled to the movable die 14 by inserting the tongue 32 of the auxiliary die element 28 into the groove 24 of the movable die 14 along the first axis 26. The auxiliary die element 28 can be made of steel or aluminum. Additionally, the auxiliary die element 28 can be configured to form the complex geometrical feature 38 feature in metal part 36 in a direction perpendicular to the first axis 26. In another configuration, with reference to FIG. 4A, coupling the auxiliary die element 28 to the movable die 14 includes coupling the first auxiliary die element 238*a*, the second auxiliary die element 238*b*, and the third auxiliary die element 238*c* to the movable die 14.

According to one aspect, after the auxiliary die element 28 is coupled to the movable die 14, a release agent can be applied (e.g., spray, mist, etc.) to the auxiliary die element 28, the stationary die 12, the movable die 14, and the one or more sliding dies 16. The release agent may be desirable so that the metal part 36 can easily separate from the die casting system 10.

At 530, the movable die 14 can be actuated along the first axis 26 to engage with the stationary die 12 and form at least a portion of the die cavity 34.

At 540, the one or more sliding dies 16 can be actuated to engage with the movable die 14 and the stationary die 12 to form at least a portion of the die cavity 34.

At 550, a metal material can be injected into the die cavity 34 to form the metal part 36.

At 560, the one or more sliding dies 16 can be retracted from the movable die 14, the stationary die 12, and/or the metal part 36.

At 570, retracting the movable die 14 along the first axis 26 so that the auxiliary die element 28 decouples from the movable die 14. In other words, the groove 24 of the movable die 14 is pulled away from the tongue 32 while the metal part 36 prevents axial movement of the auxiliary die element 28.

At 580, the auxiliary die element 28 can either fall from the metal part 36 or can be removed by an operator or machine after the movable die 14 is retracted. Thus, the metal part 36 is no longer restrained by the die casting system 10 and can be reused again in additional forming processes.

At 590, the method 500 ends.

A number of implementations have been described. Nevertheless, it will be understood that various modifications may be made without departing from the spirit and scope of the disclosure. Accordingly, other implementations are within the scope of the following claims.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A die casting system, comprising:

a first die having a first cavity-forming surface;

a second die having a second cavity-forming surface and configured to move with respect to the first die along a first axis;

one or more sliding dies that each have a third cavity-forming surface and are configured to move with respect to and engage with the first die and the second die;

one or more auxiliary die elements removably coupled to the second die and each having a fourth cavity-forming surface, the one or more auxiliary die elements each extending from the second die in a direction perpendicular to the first axis; and a die cavity for forming a metal part between the first, second, third, and fourth cavity-forming surfaces, the die casting system including an open position and a closed position, and the one or more auxiliary die elements being configured to decouple from the second die and fall from the die cavity in a direction perpendicular to the first axis while the die casting system moves from the closed position to the open position.

2. The die casting system of claim 1, wherein the first die is stationary with respect to the first axis.

3. The die casting system of claim 1, wherein the second die comprises one or more grooves that extend with respect to the first axis and the one or more auxiliary die elements each comprise a tongue configured for the one or more grooves.

4. The die casting system of claim 1, wherein the one or more auxiliary die elements are made of aluminum or steel.

5. The die casting system of claim 4, wherein at least one of the one or more auxiliary die elements is brick shaped.

6. The die casting system of claim 4, wherein at least one of the one or more auxiliary die elements includes a block shape.

7. The die casting system of claim 4, wherein at least one of the one or more auxiliary die elements includes a disc shape.

8. The die casting system of claim 4, wherein at least one of the one or more auxiliary die elements includes a cylindrical shape.

9. A method of high pressure die casting, comprising:

coupling at least one auxiliary die element to a movable die;

actuating the movable die along a first axis to engage with a stationary die;

actuating one or more sliding dies to engage with the movable die and the stationary die to form a die cavity;

injecting a metal material into the die cavity to form a metal part;

retracting the one or more sliding dies from the movable die and the stationary die; and retracting the movable die so that the at least one auxiliary die element decouples from the movable die and falls from the die cavity in a direction perpendicular to the first axis.

10. The method of claim 9, wherein coupling the at least one auxiliary die element to the movable die further comprises inserting a tongue of the at least one auxiliary die element into a groove of the movable die with respect to the first axis.

11. The method of claim 9, wherein coupling the at least one auxiliary die element to the movable die further comprises coupling a first auxiliary die element, a second auxiliary die element, and a third auxiliary die element to the movable die.

12. The method of claim 9, further comprising forming the at least one auxiliary die element from aluminum or steel.

13. The method of claim 12, further comprising forming a feature in the metal part using the at least one auxiliary die element, the feature extending in a direction perpendicular to the first axis.

14. The method of claim 13, further comprising providing the at least one auxiliary die element with a brick shape.

15. The method of claim 13, further comprising providing the at least one auxiliary die element with a block shape.

16. The method of claim 13, further comprising providing the at least one auxiliary die element with a disc shape.

17. The method of claim 13, further comprising providing the at least one auxiliary die element with a cylindrical shape.

18. The method of claim 9, further comprising spraying the at least one auxiliary die element, the stationary die, the movable die, and the one or more sliding dies with a release agent.

* * * * *